US005828280A

United States Patent [19]

Spivey, Jr. et al.

[11] Patent Number: 5,828,280

[45] Date of Patent: Oct. 27, 1998

[54] PASSIVE CONDUCTOR HEATER FOR ZERO BOILOFF SUPERCONDUCTING MAGNET PRESSURE CONTROL

[75] Inventors: John W. Spivey, Jr., Cheraw; William S. Stogner; Daniel C. Woods, both of Florence, all of S.C.

[73] Assignee: General Electric Company, Milwaukee, Wis.

[21] Appl. No.: 839,521

[22] Filed: Apr. 14, 1997

[51] Int. Cl.[6] ..... H01F 1/00

[52] U.S. Cl. ..... 335/216; 335/300

[58] Field of Search ..... 335/216, 299, 335/300; 174/15.4, 15.1–2, 15 VA, 17 VA, 17.07; 505/1; 324/318, 319, 320, 321

[56] References Cited

U.S. PATENT DOCUMENTS

| | | | |
|---|---|---|---|
| 4,543,794 | 10/1985 | Matsutani et al. | 62/54 |
| 5,018,359 | 5/1991 | Horikawa et al. | 62/51.1 |
| 5,291,168 | 3/1994 | Woods et al. | 335/216 |
| 5,657,634 | 8/1997 | Woods | 165/156 |

*Primary Examiner*—Lincoln Donovan

*Attorney, Agent, or Firm*—Irving M. Freedman; John H. Pilarski

[57] ABSTRACT

A passive non-electric pressure control system for a superconducting magnet cryogen vessel to maintain internal pressure above the outside pressure to avoid cryopumping utilizes a passive thermal conductor extending from the outside atmosphere into the vessel. The selective amount of penetration of the thermal conductor into the cryogen vessel controls the amount of heat transferred to the interior of the vessel and thus controls the internal pressure of the vessel.

18 Claims, 3 Drawing Sheets

PASSIVE CONDUCTOR HEATER FOR ZERO BOILOFF SUPERCONDUCTING MAGNET PRESSURE CONTROL

FIELD OF INVENTION

This invention relates generally to superconducting magnets utilizing a liquid cryogen such as helium, and more particularly to a passive conductive heater for maintaining pressure within the superconducting magnet above the surrounding atmospheric pressure.

BACKGROUND OF INVENTION

As is well known, a magnet coil can be made superconducting by placing it in an extremely cold environment, such as by enclosing it in a cryostat or pressure vessel and reducing its temperature to superconducting levels such as 4°–10° Kelvin. The extreme cold reduces the resistance of the magnet coil to negligible levels, such that when a power source is initially connected to the coil for a period of time to introduce a current flow through the coil, the current will continue to flow through the coil due to the negligible coil resistance even after power is removed, thereby maintaining a strong, steady magnetic field. Superconducting magnets find wide application, for example, in the field of magnetic resonance imaging (hereinafter "MRI").

In a typical magnet, the main superconducting magnet coils are enclosed in a cylindrically shaped pressure vessel which is in turn contained within an evacuated vessel and which forms an imaging bore in the center. The magnetic field in the imaging bore must be very homogenous and temporally constant for accurate imaging.

Superconducting temperatures are commonly obtained by boiling a liquid cryogen, typically liquid helium within the pressure vessel. However, while the use of liquid helium to provide cryogenic temperatures is widely practiced and is satisfactory for MRI operation, the provision of a steady supply of liquid helium to MRI installations all over world and its storage and use has proved to be difficult and costly. As a result, considerable effort has been directed at the use of helium recondensing systems to recondense the helium gas resulting from the boiling back to liquid helium.

Superconducting magnets utilizing recondensing are often referred to as zero is boiloff (zero BO) magnets. In such arrangements the pressure within the helium vessel must be maintained at pressures above the exterior atmospheric pressure to prevent cryopumping. Cryopumping occurs when a helium vessel pressure is less than the surrounding atmospheric pressure such that contaminants can be drawn into the helium vessel and could cause blockages in the magnet penetration adversely affecting performance of the MRI. Helium vessel pressure below atmospheric pressure can result if the cooling capacity of the cryogenic recondenser exceeds the heat load from the surroundings, namely the cryostat. A typical electrical pressure control system to avoid cryopumping requires a sensor, a controller, wiring, a transducer and an internal heater which is turned on and off by the electrical control system in response to variations in pressure within the helium vessel. However, "electrical noise" generated by the control system degrades the quality of images produced by the MRI imaging system. The variations in current flow through the electrical heater produces time varying magnetic fields which can induce eddy currents and superimpose a magnetic field on the main magnetic field.

OBJECTS AND SUMMARY OF THE INVENTION

It is an object of the present invention to provide a non-electrical passive control for the pressure within a superconducting magnet.

It is a further object of the present invention to provide a superconducting magnet passive adjustable thermal conductor, providing heat which varies in response to the pressure within a superconducting magnet.

SUMMARY OF THE INVENTION

In accordance with this invention, a superconducting magnet assembly includes a helium pressure vessel enclosing a magnetic coil with the boiling of the helium cooling the coil to superconducting temperatures. The resulting helium gas is recondensed to liquid helium by a recondensing mechanism for reuse. A passive non-electric pressure control means is provided to maintain the pressure within the magent assembly above that of the surrounding atmospheric pressure in order to prevent drawing contaminants into the vessel if the internal pressure were below that of the surrounding atmosphere. The passive thermal conductor heater extends into the magnet assembly with its inner portion exposed to the interior of the magnet assembly, and the outer portion exposed to, and heated by, the ambient temperature outside the magnet assembly. The thermal conductor conducts heat from the outside atmosphere to the interior of the magnet assembly. The small amount of heat introduced is adequate to vary the pressure within the magnet with the amount of heat controlled by the amount of the penetration of the inner portion of the thermal conductor into the magnet. A heat sink on the thermal conductor outside the magnet increases the thermal conductivity. The thermal conductor passes through a thermal coupling and a stop on the inner end of the thermal conductor prevents complete removal of the thermal conductor without disassembly of the vacuum coupling.

Automatic control means include an expansion joint such as a bellows which moves in response to variations in the pressure within the pressure vessel. The expansion joint is secured at one end to the thermal conductor and at the other end to the pressure vessel such that the pressure within the pressure vessel is allowed to exert force against the interior of the bellows. Movement of the bellows, such as by expansion caused by an increase of pressure within the pressure vessel, causes a corresponding movement of the thermal conductor decreasing the penetration of the thermal conductor and its heating, compensating for the increase in pressure. More particularly, the bellows surrounds the thermal conductor, and at the interior end is secured to an end member which includes one or more openings to expose the interior of the bellows to the pressure within the pressure vessel. Manual adjustment means such as cooperating threads may be provided to enable manual adjustment of the penetration of the thermal conductor. A vacuum vessel surrounds the pressure vessel such that the thermal conductor passes through the chamber formed between two vessels.

BRIEF DESCRIPTION OF THE DRAWINGS

The features of the invention believed to be novel are set forth with particularity in the appended claims. The invention itself, however, both as to organization and method of operation, together with further objects and advantages thereof, may best be understood by reference to the following description in conjunction with the accompanying drawings in which like characters represent like parts throughout the drawings, and in which:

DETAILED DESCRIPTION OF THE INVENTION

Figure 1:
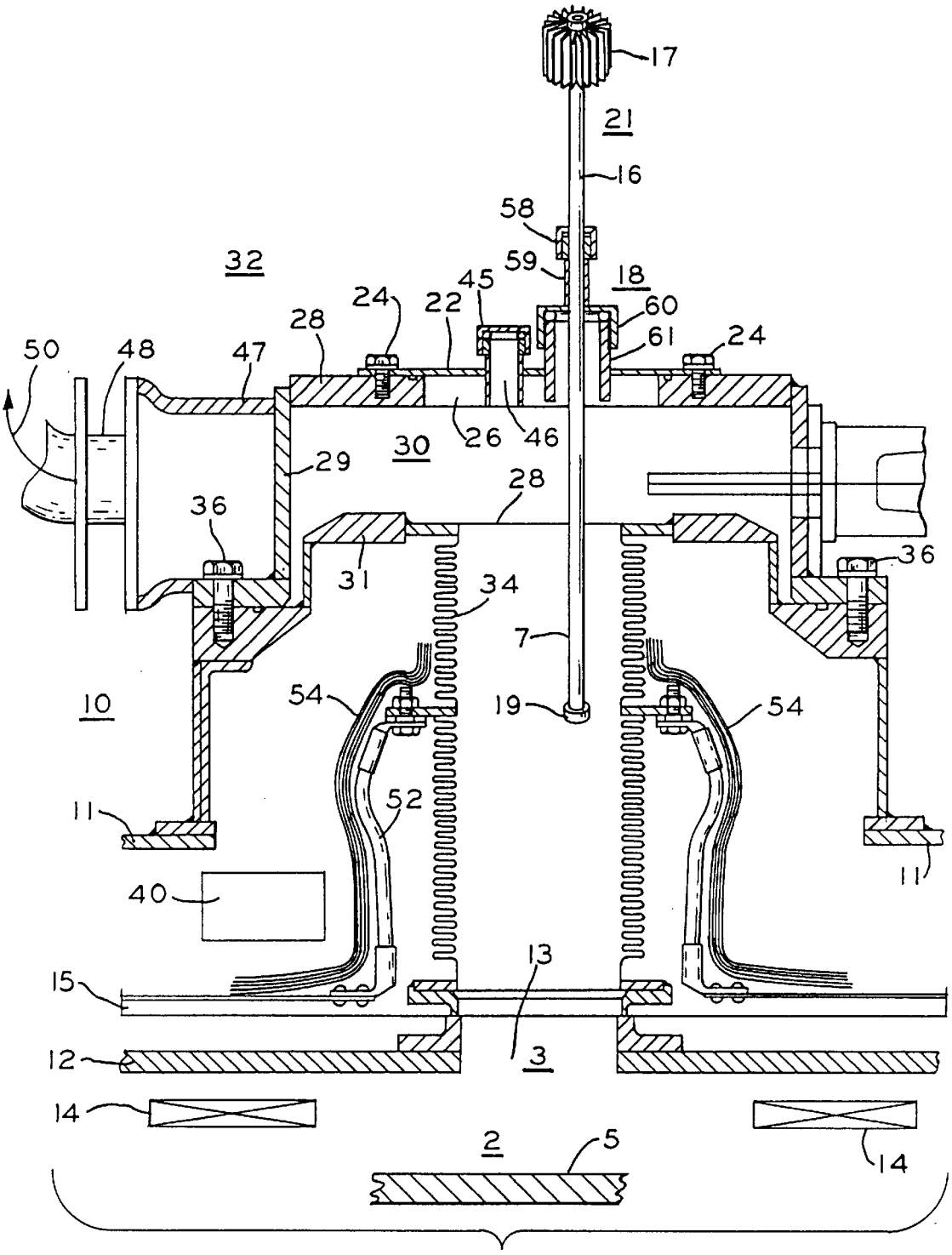
FIG. 1 is a simplified cross-sectional drawing of a portion of a superconducting magnet incorporating the invention.

Referring first to FIG. 1, superconducting magnet 10 includes helium pressure vessel 12 in which boiling of liquid helium indicated generally as 5 provides superconducting temperatures to a plurality of main magnet coils such as 14 to provide a homogenous magnetic field in the imaging volume 7 within the central region of the magnet coils. Surrounding pressure vessel 12 is an external vacuum vessel 11 with one or more heat shields 15 interposed between the vacuum vessel and the pressure vessel. Positioned over opening 13 in pressure vessel 12 is a plenium or access port 30 connecting outside atmosphere 32 through vacuum vessel 11 to the interior of the pressure vessel. Interconnecting structure includes penetration cover 22 secured by bolts 24 to ring or collar 28 and cylinder 29, and through ring 31 to bellows 34 interposed between ring 31 and pressure vessel 12 with the bellows cencetrically surrounding opening 13 in the pressure vessel.

Suitable interconnecting fasteners such as bolts 36 enable the assembly and disassembly of the plenium, and the selective separation or isolation of the interior of pressure vessel 12 and vacuum vessel 11 from outside atmosphere 32 surrounding superconducting magnet 10.

Positioned within vacuum coupling 18 which is secured to penetration cover 22 is thermal conductor assembly 21 which extends between surrounding atmosphere 32 outside superconducting magnet 10 to the interior thereof where it is exposed to the pressure of the helium gas shown generally as 3 within pressure vessel 12.

Figure 2:
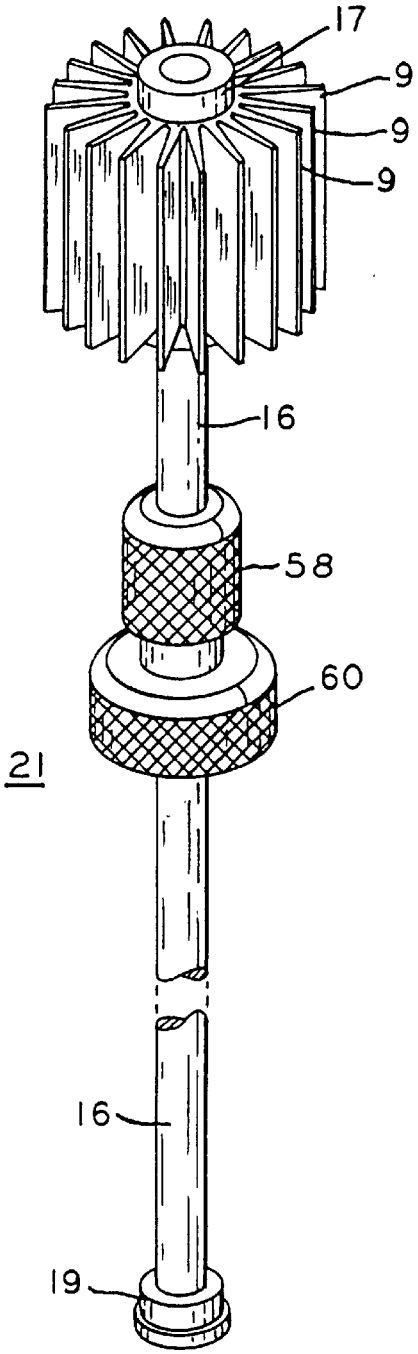
FIG. 2 is an enlarged perspective drawing of the thermal conductor of FIG. 1.
Figure 3:
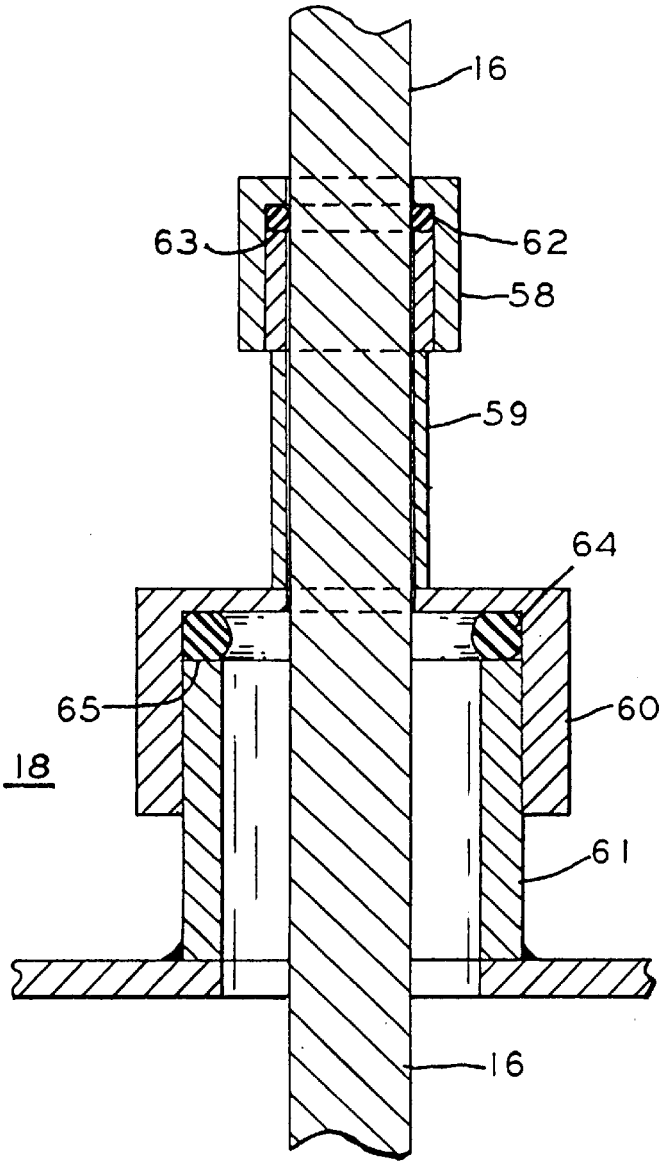
FIG. 3 is an enlarged drawing of the vacuum coupling for the thermal conductor of FIG. 1.

Thermal conductor 21 is best shown in FIG. 2 and the vacuum coupling 18 through which a thermal conductor passes is best shown in FIG. 3. Referring to FIGS. 2 and 3, thermal conductor assembly 21 includes copper cylindrical shaft 16 with aluminum heat sink 17 at the outside end thereof including a plurality of radially extending fins 9 thermally connected to the end of the thermal conductor which extends into a surrounding atmosphere 32 (see FIG. 1) outside vacuum vessel 11. Heat sink 17 enhances heat transfer from atmosphere 32 to shaft 16. Shaft 16 passes through vacuum coupling 18 which includes a pair of inverted cup-shaped nuts 58 and 60 which are internally threaded to cylindrical barrels 59 and 61 such that rotation of knurled cup-shaped member 58 compresses O-ring 62 between the inside of cup-shaped member 58 and the upper end of cylinder or barrel 59. Similarly, manual rotation of knurled cup-shaped member 60 on cooperating threaded cylindrical barrel 61 compresses O-ring 64 between the upper edge 65 of the cylindrical barrel and the bottom of the cup-shaped member. Heat sink 17 and shaft 16 may be any thermally conductive material such as copper or aluminum.

After thermal conductor 16 is positioned within vacuum coupling 18 at the desired location with the desired amount of copper conductor 16 protruding into the interior of external vacuum vessel 11 to contact boiled helium gas from pressure vessel 12, cup-shaped threaded nut members 58 and 60 are upon installation tightened down on O-rings 62 and 64, respectively, to provide a vacuum tight fitting or coupling 18. Subsequent selective adjustment, removal and/or insertion of thermal conductor 16 can be accomplished by loosening and tightening of only cup-shaped member 58. Stop member 19 is threaded onto the bottom of thermal conductor 16 as best shown in FIG. 1, providing a flared end portion which is of a larger diameter than the interior of cylindrical barrel 59 to prevent thermal conductor 16 from being blown out through vacuum coupling 18 in the event of a quenching or sudden undesired rapid boiling of the liquid helium within superconducting magnet 10 which could produce an undesired rapid pressure rise of helium gas 3. Thermal conductor 16 can thus only be driven up until it contacts the bottom of cylindrical barrel 59.

Referring again to FIG. 1, a burst disk 48 is conventionally included adjacent to 3-inch diameter vent 47 such that if the burst disk is fractured by excessive helium gas 3 pressure buildup within vacuum vessel 11 the helium gas is allowed to vent to atmosphere 32 as shown by arrow 50. Burst disk 48 is appropriately configured to rupture at a preselected pressure such as 20 psi for venting helium gas to atmosphere 32 in the event of a malfunction or quenching of superconducting magnet 10.

Cap 45 covers power lead opening 46 which provides a selective opening for the insertion for an appropriate power lead assembly (not shown) which is used to apply electrical power to coils 14 to establish superconducting operation, after which the power leads are removed through the power lead opening and the power lead cap is secured in place over the power lead opening.

Thermal strip 52 connects between bellows 34 and heat shield 15 and is surrounded by insulation 54. Helium recycling apparatus, shown generally as 40, is provided to recondense helium gas back into liquid helium which flows by gravity back to liquid helium supply 5. Suitable helium recondensing apparatus is shown in U.S. Pat. No. 5,597,423, entitled Cryogen Recondensing Superconducting Magnet, issued Jan. 28, 1997 and assigned to the same assignee as the present invention.

In operation thermal conductor assembly 21 operates to conduct heat from outside atmosphere 32 through aluminum heat sink 17 exposed to the atmosphere. The heat is transmitted through copper thermal conductor 16 to the interior of vacuum vessel 11 where it contacts the helium gas 3 atmosphere generated by the boiling of liquid helium 5 in pressure vessel 12 to raise the temperature of the helium gas and hence its pressure above the pressure of the surrounding atmosphere 32. This avoids cryopumping. The amount of insertion of inner portion 7 of thermal conductor assembly 21 is adjusted through adjustment of vacuum coupling 18 by first hand loosening cup-shaped members 58 by rotating their knurled surfaces and subsequently retightening them after thermal conductor 16 is moved to the selected insertion depth of inner portion 7 of the thermal conductor. For a given superconducting magnet 10 the cross-section area of thermal conductor 16 is preselected along with its material which may be copper or aluminum or an alloy which provides good thermal conductivity, and the dimensions of fins 9 of heat sink 17 are dimensioned to provide the approximate amount of heat transfer desired.

Figure 4:
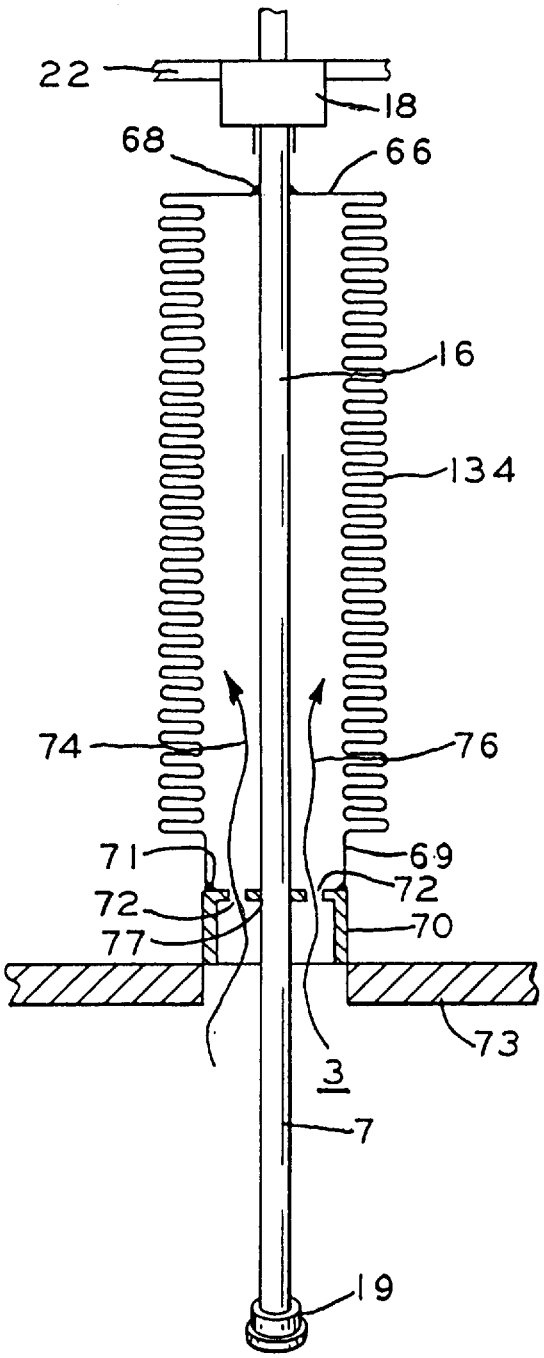
FIG. 4 shows the addition of a bellows to the thermal conductor to provide automatic pressure response control.

It is possible to obtain further automatic temperature adjustment without the use of an electrical or electronic pressure control system along with its problems of electrically generated interference with the imaging system associated with superconducting magnet 10 through the generation of electrical noise. FIG. 4 shows an arrangement which automatically responds to subsequent small variations of helium gas 3 pressure. Referring to FIG. 4, thermal conductor 16 extends through bellows 134 which is closed at its upper end by closure end member 66 the central portion of which is welded 68 to thermal conductor 16 such that the thermal conductor moves with movement of the closure end member. Lower end 69 of expansion joint or bellows 134 is welded 71 to inverted cup-shaped member 70 which surrounds thermal conductor 16. Cup-shaped member 70 includes a plurality of apertures 72 which allows helium gas 3 flow into the interior of expansion joint or bellows 134 as indicated by arrows 74 and 76. The bottom of cup-shaped member 70 is fixed to member 72 such that variations of pressure of helium gas 76 within expansion joint 134 will move closure end member 66 in response to movement (expansion or contracting) of bellows 134 resulting from variations in the pressure of helium gas 3. For example, an increase in pressure will expand bellows 134 and push end member 66 upward pulling thermal conductor 16 upward away from the interior region of the pressure vessel 12. This movement is facilitated by the clearance fit of thermal conductor 16 through aperture 77 in the central region of cup-shaped member 70. Conversely, a decrease in pressure will cause contraction of bellows 134 pulling end member 66 downward and moving thermal conductor 16 further into pressure vessel 12 increasing heat transfer from outside atmosphere 32 to the interior of the pressure vessel to increase the internal pressure of helium gas 3 to prevent cryopumping.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A zero boiloff recondensing superconducting magnet assembly including a sealed pressure vessel enclosing a magnet coil and a liquid cryogen the boiling of which cools the coil to superconducting temperatures comprising with recondensing apparatus to recondense the boiled cryogen back to liquid cryogen:

passive non-electric pressure control means to control the pressure within said vessel to maintain said pressure elevated above that outside said pressure vessel to prevent cryopumping;

said pressure control means including a passive thermal conductor extending from outside said vessel through said vessel with a portion thereof exposed to the exterior of said pressure vessel and a portion exposed to the interior of said pressure vessel; and means to selectively control the amount of penetration of said thermal conductor into said magnet assembly to control the amount of heat conducted by said thermal conductor from the portion outside said magnet assembly vessel to the interior of said pressure vessel;

whereby the pressure within said pressure vessel is controlled by the amount of said penetration of said thermal conductor to provide selected conduction heating from the exterior to the interior of said vessel to maintain the elevated pressure and prevent subatmospheric pressures within said vessel.

2. The superconducting magnet pressure control system of claim 1 wherein a heat sink is positioned outside said magnet assembly thermally connected to said thermal conductor to enhance the controlled heat conduction to the interior of said pressure vessel.

3. The superconducting magnet pressure control system of claim 2 wherein said heat sink includes a plurality of radially extending vanes extending from said thermal conductor.

4. The superconducting magnet pressure control system of claim 3 wherein said thermal conductor and said heat sink are thermally conductive metal selected from the group consisting of copper and aluminum.

5. The superconducting magnet pressure control system of claim 4 wherein said thermal conductor is copper and said heat sink is aluminum.

6. The superconducting magnet pressure control system of claim 1 wherein said thermal conductor passes through an opening in a selectively loosenable vacuum seal assembly on said vessel.

7. The superconducting magnet pressure control system of claim 6 wherein an enlarged stop member is provided on the interior portion of said thermal conductor, said stop member being larger than said opening to prevent said thermal conductor from being blown out of said pressure vessel upon an undesired rapid rise of said pressure within said vessel.

8. The superconducting magnet pressure control system of claim 7 including at least one knurled surface on said vacuum coupling facilitates manual manipulation thereof to enable selective penetration of said thermal conductor through said vacuum seal assembly.

9. The superconducting magnet pressure control system of claim 8 wherein said vacuum coupling includes at least one compressible O-ring.

10. The superconducting magnet pressure control system of claim 1 wherein said means to control the amount of penetration includes non-electric means to vary said amount of penetration of said thermal conductor into said vessel in response to variations in the pressure within said vessel.

11. The superconducting magnet pressure control system of claim 10 wherein said means responsive to said pressure variations comprises an expansion joint secured at one end to said thermal conductor and at the other end to said pressure vessel with the intermediate region thereof exposed to and moving in response to the pressure within said vessel.

12. The superconducting magnet pressure control system of claim 11 wherein said expansion joint includes a bellows the length of which varies in accordance with the force exerted thereon by the pressure of the atmosphere within said vessel.

13. The superconducting magnet pressure control system of claim 12 wherein the end of said bellows closest to the central region of said pressure vessel is secured to a fixed end member which includes at least one opening to expose the interior of said bellows to said pressure within said vessel.

14. The superconducting magnet pressure control system of claim 13 wherein said end member surrounds said thermal conductor and said bellows is concentric to said thermal conductor.

15. The superconducting magnet pressure control system of claim 14 wherein said bellows is connected to a diaphragm positioned between one end of said bellows and said thermal conductor to vary said penetration of said thermal conductor in response to pressure variations within said pressure vessel as sensed by said bellows.

16. The superconducting magnet pressure control system of claim 15 wherein said control means further include means to manually adjust said penetration of said thermal conductor into said vessel.

17. The superconducting magnet pressure control system of claim 16 wherein said means to manually adjust said penetration includes a threaded portion of said thermal conductor mating with a fixed thread in said seal assembly.

18. The superconducting magnet pressure control system of claim 17 wherein said vessel includes a pressure vessel positioned within an evacuated vessel and said thermal conductor passes through a chamber formed between said bellows and said evacuated vessel.

* * * * *